US006673750B2

(12) United States Patent
Hirata et al.

(10) Patent No.: US 6,673,750 B2
(45) Date of Patent: Jan. 6, 2004

(54) LUBRICATING COMPOSITION

(75) Inventors: Masakazu Hirata, Mie (JP); Atsushi Morooka, Mie (JP); Hidenobu Mikami, Mie (JP); Toshiyuki Mizutani, Mie (JP); Seiichi Takada, Mie (JP); Masaaki Honda, Mie (JP); Yoshihiko Oeda, Tokyo (JP); Katsumi Nagano, Tokyo (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 10/079,263

(22) Filed: Feb. 19, 2002

(65) Prior Publication Data

US 2003/0060376 A1 Mar. 27, 2003

(30) Foreign Application Priority Data

Feb. 22, 2001 (JP) ..... 2001-046476
May 7, 2001 (JP) ..... 2001-136453
May 23, 2001 (JP) ..... 2001-154108

(51) Int. Cl.[7] ..... C10M 169/02; C10M 137/04

(52) U.S. Cl. ..... 508/136; 508/182; 508/183; 508/390; 508/433; 508/441; 508/539; 508/552; 508/581; 508/582; 508/584; 508/591

(58) Field of Search ..... 508/441, 433, 508/552, 582, 136

(56) References Cited

U.S. PATENT DOCUMENTS 4,324,673 A * 4/1982 Christian et al.
5,401,105 A * 3/1995 Suzuki et al. ..... 384/470
5,462,684 A * 10/1995 Naka et al.
5,552,067 A * 9/1996 Placek ..... 508/433
5,728,659 A * 3/1998 Naka et al. ..... 508/552
5,792,733 A * 8/1998 Minami et al. ..... 508/422
5,804,536 A * 9/1998 Asao et al. ..... 508/100
5,824,628 A * 10/1998 Coates et al. ..... 508/433
6,251,841 B1 * 6/2001 Koizumi et al. ..... 508/390
6,329,326 B1 * 12/2001 Iso et al. ..... 508/182
6,420,321 B1 * 7/2002 Akiyama et al. ..... 508/259
6,528,457 B2 * 3/2003 Howell et al. ..... 508/180

FOREIGN PATENT DOCUMENTS

| | | |
|---|---|---|
| JP | 03-53805 | 7/1991 |
| JP | 05-061501 | 2/1993 |
| JP | 06-117932 | 5/1994 |
| JP | 07-071422 | 3/1995 |

OTHER PUBLICATIONS

Smalheer et al, "Lubricant Additives", Section I–Chemistry of Additives, pp. 1–11, 1967.*

* cited by examiner

*Primary Examiner*—Ellen M. McAvoy
(74) *Attorney, Agent, or Firm*—Hedman & Costigan, P.C.

(57) ABSTRACT

Disclosed is a lubricating composition such as a lubricant, a lubricating grease, or a rust preventive oil for use in a torque limiter and a ball-and-roller bearing; the lubricating composition having chemical attack resistance for a synthetic resin molded product. The lubricating composition comprises as a base oil at least one synthetic saturated hydrocarbon oil selected from the group consisting of a poly-α-olefin, and an ethylene-α-olefin copolymer. When a phosphoric acid ester is used as a compounding agent, or at lease one lubricating grease selected from the group consisting of an urea compound, silica powder, and bentonite powder is mixed therein, the lubricating composition is a rust preventive oil using a metal salt of sulfonic acid and the like. The lubricating composition is suitably used for machine parts of a business machine including the synthetic resin molded product.

17 Claims, 7 Drawing Sheets

LUBRICATING COMPOSITION

BACKGROUND OF THE INVENTION

The present invention relates to a lubricating composition such as a lubricant, a lubricating grease, and a rust preventive oil for use in a torque limiter, and a ball-and-roller bearing. More particularly, the present invention relates to a lubricating composition used for machine parts of a business machine including a synthetic resin molded product as peripheral parts; the lubricating composition preventing chemical attacks to the synthetic resin molded product.

A torque limiter is one of the machine parts of business machine, and is used in a paper feed mechanism, and a tension mechanism including a ribbon and a sheet. For example, torque is produced by utilizing tightening and binding force in a radial direction to an inner ring of a spring, and by pressing and sliding a friction board with the spring in a thrust direction. In either case, friction force is used to produce torque.

To prevent wear, abnormal exothermicity, abnormal sound of seizing and the like between the inner ring of the torque limiter and the spring or the friction board, and between the friction boards, a lubricating oil or grease is used.

Generally, the inner ring of the torque limiter is made of sintered metal material, which is immersed in the lubricant or the grease.

A typical lubricant or lubricating grease for the torque limiter often comprises a mineral oil, alkylnaphthalene, or an ester as a base oil, and various additives such as an anti-wear agent depending on applications. The torque limiter is required to have and maintain an oil film on its parts for a long period of time. Performance of the bearing depends on how a metal contact is suppressed, and a friction coefficient is stabilized. In particular, the torque limiter used in the paper feed mechanism of a copy machine or a printer, or the tension mechanism of the ribbon and the sheet requires the lubricant that keeps variance of the torque extremely low, and does not produce a metal contact sound.

The peripheral parts of the torque limiter are made of a non-crystalline resin having good moldability such as polycarbonate and an ABS resin. Such resin may be subjected to chemical attacks by a contact with an oil or its vapor resulting from a leak of the lubricant used in the torque limiter. The chemical attack is a phenomenon that microstreaks propagate on a surface of the resin to cause hair cracks, crazing, cracks, and surface roughness, resulting in breakage of the resin board.

Commercially available lubricants may have the following problems: the oil film is broken at early stage to cause an abnormal sound, or even if the abnormal sound is not produced, torque is reduced because a friction reducing effect is too high. At the paper feed of the copy machine or the printer, the torque limiter is used as a paper moving mechanism utilizing torque attributed to the torque limiter. Problematic reduction in torque and production of the abnormal sound are caused by wear of a friction surface for a prolonged use, and shear of the lubricant. When the business machine is frequently used, viscosity of the lubricant is reduced by exothermic, thereby lowering its performance. If the lubricant used in the torque limiter is leaked or vaporized to outside of the torque limiter for any reasons, the peripheral parts, especially non-crystalline material such as polycarbonate and the ABS resin, may be subjected to chemical attacks. Therefore, it is urged to provide a lubricant having excellent chemical attack resistance. The existing lubricants using naphthene based mineral oil having an aromatic ring in the molecule, alkylnaphthalene, or alkyldiphenylether as a base oil have high ability to produce the oil film, and satisfy torque performances required for the torque limiter. Such lubricant comprising the aromatic ring or a polar group in the molecule as the base oil can attack the non-crystalline resin material. There is no lubricant satisfying both the lubricating performance (torque performance) and chemical attack resistance required for the torque limiter.

At a fixing portion of a copy machine or a printer utilizing an electrophotographic apparatus, a ball-and-roller bearing is widely used to support rotatably the fixing roller. At the fixing portion, a toner charged and attached to a paper is pressed at about 250° C. at the maximum to be fixed to the paper. Thus, the ball-and-roller bearing supporting the roller at the fixing portion is often used at high temperature. In particular, a heat roll has a heater inside of a hollow axis, and is heated inside. Correspondingly, the bearing may also be used at a temperature of exceeding 200° C. The ball-and-roller bearing for supporting the heat roll may be used via an adiabatic sleeve made of a resin in order to decrease the temperature of the bearing. Nevertheless, a temperature of an end face of the bearing may reach about 200° C. by an effect of radiant heat.

One example of the conventional lubricating composition for use in the ball-and-roller bearing used at the high temperature is grease for prelubricating. The grease is typically fluorinated grease for prelubricating because it is less deteriorated at a high temperature, and provides prolonged life.

In recent years, as the demand for the electrophotographic apparatus increases, reduction in costs becomes a problem to be solved urgently. However, the aforementioned fluorinated grease is too expensive to reduce the costs of the ball-and-roller bearing used in the fixing roller of the electrophotographic apparatus.

In order to reduce the costs of the electrophotographic apparatus, there have been widely used parts made of non-crystalline resin, i.e., polycarbonate resin having both of moldability and heat resistance. Such resin is easily suffering from so-called chemical attacks by fats and oils used in the grease for prelubricating.

As an alternative of the fluorinated grease, there is used an urea grease comprising a high viscosity ester oil as the base oil. The urea grease is also used at high temperature, and is more inexpensive than the fluorinated grease. However, the urea grease easily induces chemical attacks to the polycarbonate resin. For the purpose of reduction in costs, a high viscosity ester oil is added to the fluorinated grease, undesirably resulting in a lowered dropping point.

Examples of rust preventive oil for the torque limiter and the ball-and-roller bearing include NP-0, NP-3, and NP-6 rust preventive oils in accordance with JIS K2246 (rust preventive oil).

The rust preventive oil generally includes light mineral oils. If the bearing is used while the rust preventive oil remains on a surface of the bearing, the peripheral resin molded parts are easily subjected to chemical attacks.

SUMMARY OF THE INVENTION

An object of the present invention is to provide a lubricating composition capable of preventing chemical attacks to machine parts of a business machine including a synthetic resin molded product. Examples of the machine parts of the business machine include a torque limiter, a ball-and-roller bearing and the like. Examples of the lubricating composition include a lubricant, a lubricating grease, a rust preventive oil and the like.

According to one aspect of the present invention, a lubricating composition having chemical attack resistance for a synthetic resin molded product comprises a base oil, and a compounding agent, wherein the base oil is at least one synthetic saturated hydrocarbon oil selected from the group consisting of a poly-α-olefin, and an ethylene-α-olefin copolymer.

According to other aspect of the present invention, a lubricating composition comprises at least two lubricating greases selected from the group consisting of three types of lubricating greases each having a different base oil; the first lubricating grease comprising as the base oil at least one synthetic saturated hydrocarbon oil selected from the group consisting of a poly-α-olefin, and an ethylene-α-olefin copolymer, and at least one thickener selected from the group consisting of an urea compound, silica powder, and bentonite powder; the second lubricating grease comprising a perfluoro polyether oil as the base oil, and fluororesin powder as a thickener; and the third lubricating grease comprising an alkyldiphenylether oil as the base oil, and at least one thickener selected from the group consisting of an urea compound, silica powder, and bentonite powder.

According to still other aspect of the present invention, a rust preventive oil which works as a lubricating composition comprises a base oil, a rust preventive agent, and an antioxidant, wherein the base oil is at least one synthetic saturated hydrocarbon oil selected from the group consisting of a poly-α-olefin, and an ethylene-α-olefin copolymer, wherein the rust preventive agent is at least one metal salt selected from the group consisting of a metal salt of sulfonic acid, and a metal salt of a monocarboxylic acid, and wherein the antioxidant is a phenol based antioxidant.

Conventional rust preventive oils include as a base oil a low boiling point solvent such as kerosene and mineral spirits, a low viscosity lubricant, and a mineral oil such as wax. Conventional lubricating greases include as a base oil mineral oils, alkylnaphthalene, ester and the like. A factor of a chemical attack to the polycarbonate resin has been investigated. It has been discovered that not mineral oils including a single component, but mineral oils including multiple components, especially low boiling point components, easily induce chemical attacks. The present invention is made based on such discovery. The base oil is at least one synthetic saturated hydrocarbon oil selected from the group consisting of a poly-α-olefin, and an ethylene-α-olefin copolymer, whereby no chemical attacks to the synthetic resin molded product is induced.

DETAILED DESCRIPTION OF THE PREFERRED EMBODIMENTS

Figure 1:
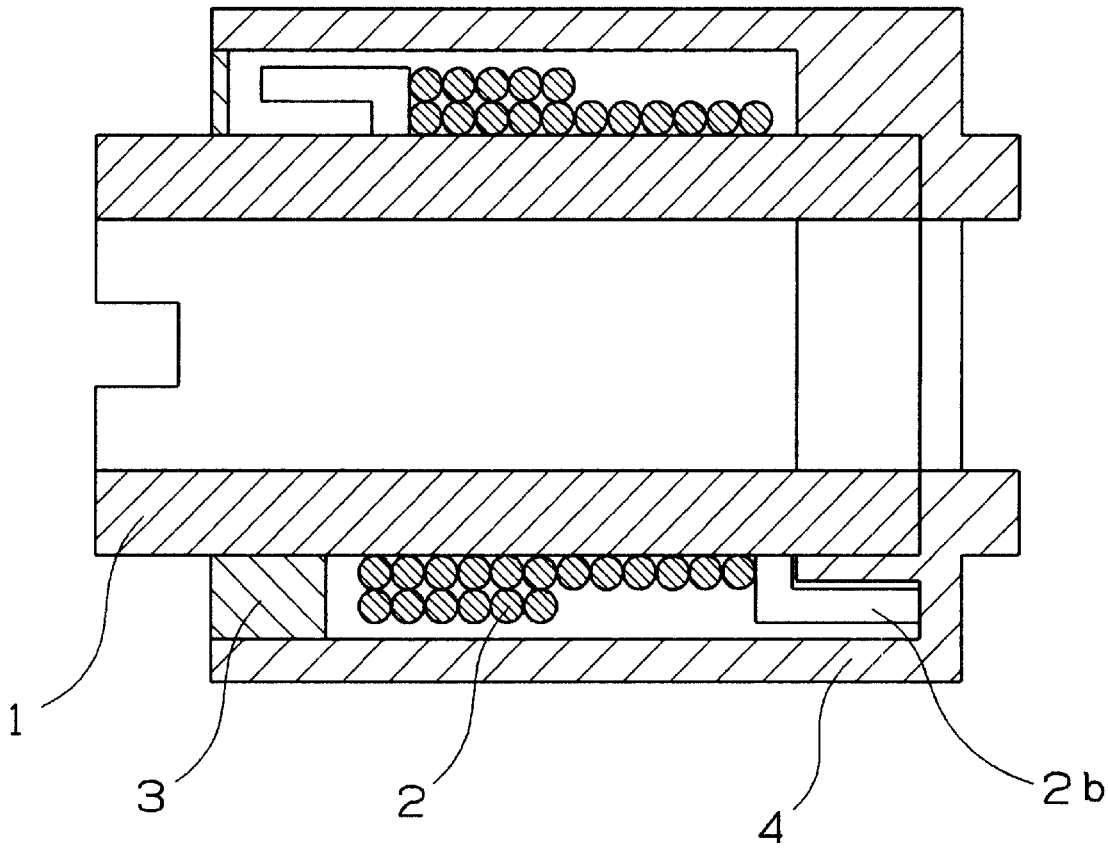
FIG. 1 is a cross-sectional view of one example of a torque limiter.

The base oil for use in the lubricating composition of the present invention is a saturated synthetic hydrocarbon oil. An oligomer of α-olefin is preferable. Examples include polymer or copolymer of α-olefin having about 3 to 20 carbon atoms such as butene-1, isobutylene-1, α-octene, and decene-1. These oligomers are liquid at room temperature. Examples of the copolymer are copolymers of ethylene and the above-described α-olefins. In the present invention, two or more of the above-described base oils can be used in combination.

Preferable base oil is a hydride of poly-α-olefin represented by the following formula (1), or of ethylene-α-olefin copolymer represented by the following formula (2). As the hydride of the poly-α-olefin, an oligomer hydride of (α-olefin having 6 to 18 carbon atoms is preferably used. As the hydride of the ethylene-α-olefin copolymer, a copolymer hydride of ethylene and α-olefin having 3 to 10 carbon atoms.

[Formula (1)]

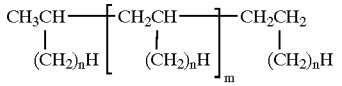

where n is an integer of 4 to 16, and m is an integer of 1 to 6.

[Formula (2)]

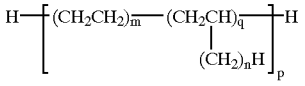

where n is an integer of 1 to 8, m is an integer of 1 to 3, q is an integer of 1 to 3, and p is a different integer depending on viscosity of the polyolefin oil.

It is preferable that the polyolefin oil used as the base oil of the lubricant or the lubricating grease be liquid at room temperature, and have kinetic viscosity of 100 $mm^2/s$ or more (at 40° C.) . If the polyolefin oil has kinetic viscosity of less than 100 $mm^2/s$, the lubricating grease comprising such polyolefin oil has too great evaporation loss to provide lubricity for a long period of time.

The above-described base oils have excellent low temperature fluidity, and low viscosity change at high temperature, whereby they have high oil film forming ability. As a result, abnormal sounds of the torque limiter, and wear of the bearing are effectively inhibited to provide a long life bearing. In addition, the base oils have excellent viscosity—temperature properties, whereby the torque can be maintained with a small variance to a change in revolution numbers of the torque limiter. Furthermore, the base oils have excellent chemical attack resistance. Even if the lubricating composition leaks outside of the torque limiter for any reasons, or contacts with the peripheral synthetic resin molded product, no chemical attack occurs.

The lubricant for the torque limiter or the compounding agent for the grease includes a phosphoric acid ester selected from aliphatic phosphoric acid ester, and phosphorous acid ester. These are excellent in relatively low chemical attacks to the synthetic resin molded product. Preferable is aliphatic phosphorous acid ester. This compounding agent functions as an anti-wear agent.

The phosphoric acid ester is represented by the following formula (3).

$$(RO)_3P{=}O \qquad \text{[Formula (3)]}$$

In the formula (3), R is preferably an alkyl group or an alkenyl group having 10 to 25 carbon atoms. Three R in the formula (3) may be the same or different. If R has less than 10 carbon atoms, stability or low friction property is deteriorated, sludge is easily produced, and the abnormal sounds are ineffectively inhibited. On the other hand, if R has more than 25 carbon atoms, it less prevents change in torque regardless of the amount of the compounding agent, that is, lubrication is ineffective. Specifically, preferable phosphoric acid ester includes trilaurylphosphate, trioleylphosphate, and tristearylphosphate.

The phosphorous acid ester is represented by the following formula (4).

$$(RO)_3P \qquad \text{[Formula (4)]}$$

In the formula (4), R is preferably an alkyl group or an alkenyl group having 10 to 25 carbon atoms for the similar reasons as described above. Three R in the formula (4) may be the same or different. Specifically, preferable phosphorous acid ester includes trioleylphoshite, trisstearylphosphite, and tris(tridecyl)phosphite.

1 to 8% by weight of the phosphoric acid ester is added based on 100 parts by weight of the base oil. If less than 1% by weight of the phosphoric acid ester is added, a friction reducing effect and torque stability are not improved. If more than 8% by weight of the phosphoric acid ester is added, chemical attack resistance is deteriorated. With the performance of the torque limiter and resin resistance taken into consideration, it is more preferable that 3 to 5% by weight of the phosphoric acid ester be added.

The lubricating composition containing as essential components the above-described base oil and the phosphoric acid ester can be used as an oily matter having fluidity, and as the greased lubricating grease.

A thickener for use in the lubricating grease is dispersed in the base oil to have a micell structure, which shows a semi-solid state. Examples include a metal soap such as a sodium soap, a lithium soap, a calcium soap, a barium soap, a calcium complex soap, an aluminum complex soap, a lithium complex soap, and a barium complex soap; inorganics such as benton, silica aero gel, sodium terephthalate, urea, polytetrafluoroethylene, hydroxy apatite, and polyethylene powder; non-soap such as an urea compound, and waxes. Preferably, the thickener comprising the lithium soap or the urea compound is suitable, because it has well-balanced total performances including mechanical stability, heat resistance, and water resistance.

The lubricating composition for the torque limiter can also incorporate antioxidants, rust preventatives, viscosity index improvers, metal deactivators, non-ash type dispersants, metallic cleaning agents, oily agents, surfactants, and defoaming agents depending on its application, as long as they do not interfere the properties of the lubricating composition.

Examples of the torque limiters in which the lubricating composition is used will be described.

FIG. 1 shows a friction type limiter in which tightening and binding force of a coil spring 2 against an inner ring 1 is used to produce torque. In the torque limiter, a coil spring 2 having a large diameter and a small diameter is disposed outside of the metal inner ring 1, and is stopped by a lid 3 and a casing 4 with hooks 2*a*, 2*b*. The lid 3 pressed into the casing 4 is rotated to change continuously tension of the spring 2 against the inner ring 1, thus torque can be freely adjusted. This is a unidirectional rotating torque limiter in which a rotating direction of the inner ring is limited by a winding direction of the spring.

Figure 2:
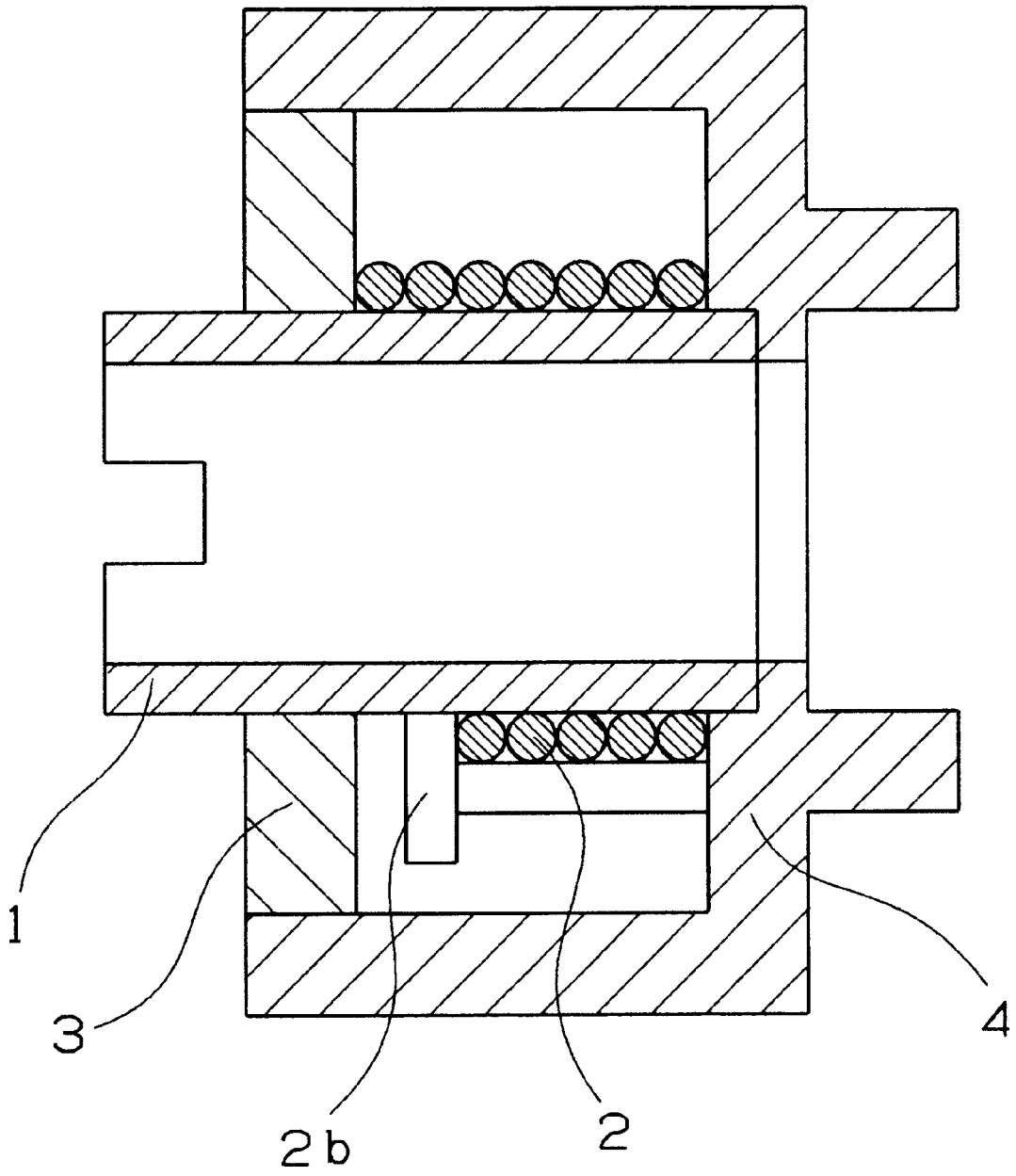
FIG. 2 is a cross-sectional view of other example of a torque limiter.

FIG. 2 shows a limiter in which a cylindrical coil spring 2 is disposed outside of a metal inner ring 1, and is stopped by a casing 4 with a hook 2*b*. Although the cylindrical spring cannot adjust the torque, interference of the inner ring is altered to change the tightening and binding force of the spring so that the torque value is determined to be capable of adjusting the torque. This is also a unidirectional rotating torque limiter in which a rotating direction of the inner ring is limited by a winding direction of the spring.

Figure 3:
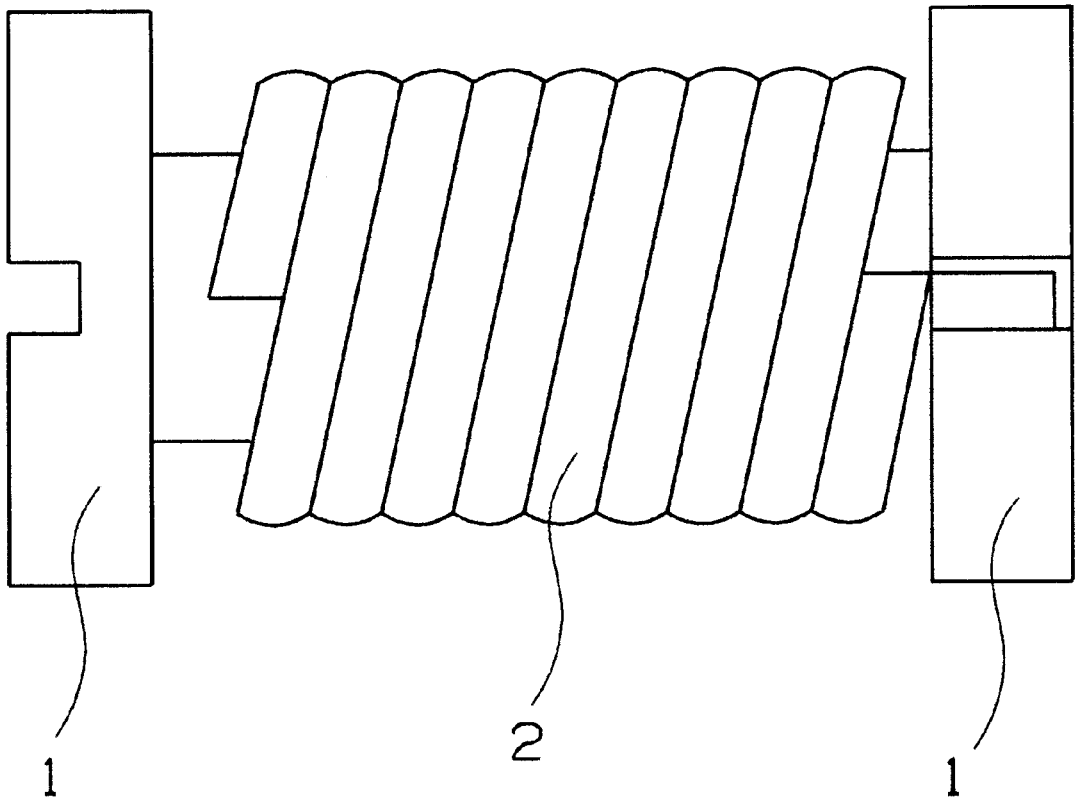
FIG. 3 is a cross-sectional view of other example of a torque limiter.

FIG. 3 shows a torque limiter in which a cylindrical coil spring 2 similar to that shown in FIG. 2 is disposed outside of metal inner rings 1 separated each other. Although the cylindrical spring cannot adjust the torque, interference of the inner ring is altered to change the tightening and binding force of the spring so that the torque value is determined. In this torque limiter, a rotating direction of the inner ring is also limited by a winding direction of the spring.

Figure 4:
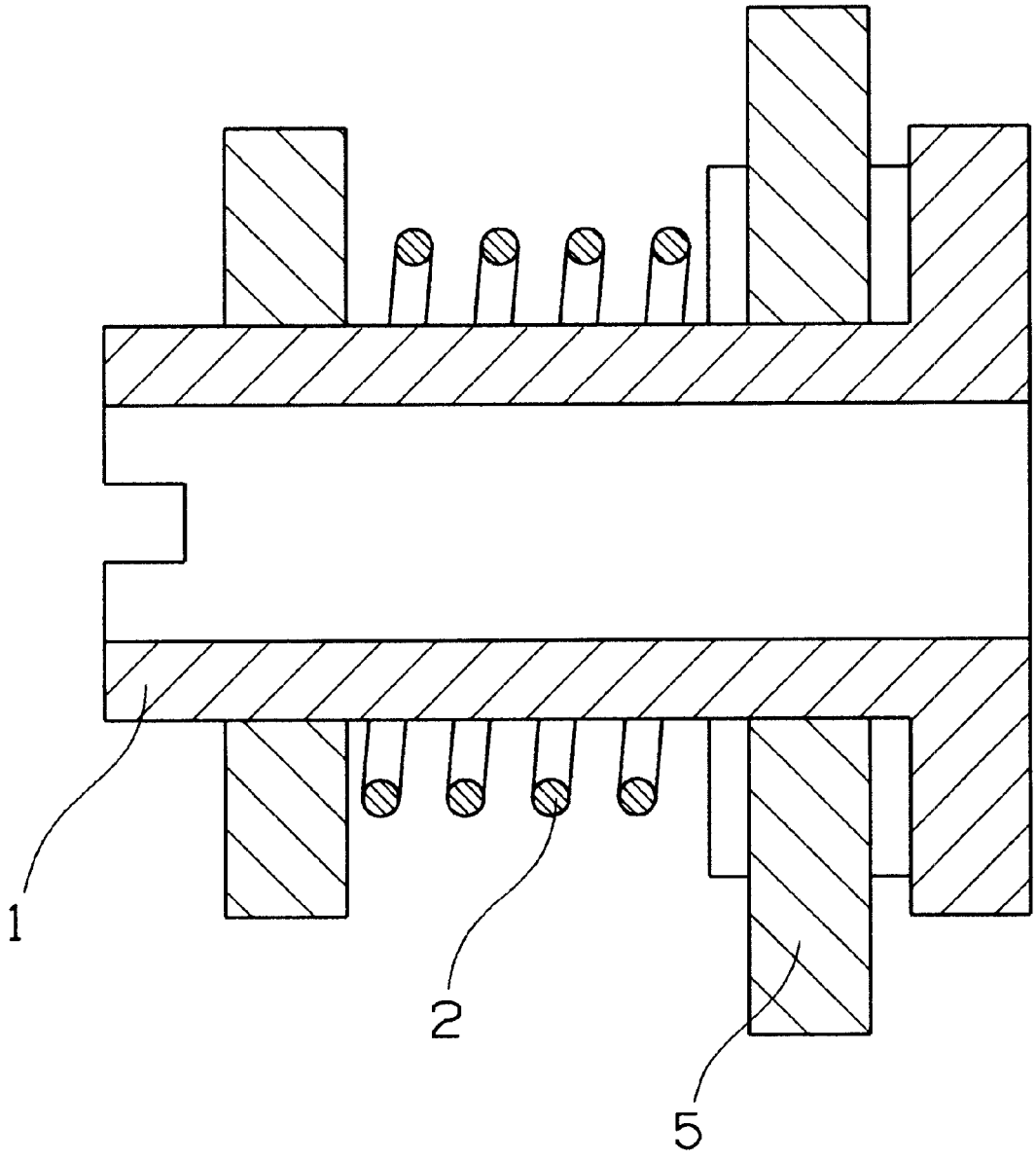
FIG. 4 is a cross-sectional view of other example of a torque limiter.

FIG. 4 shows a torque limiter in which a friction board 5 is pushed to a metal inner ring 1 with a spring 2. Torque is produced by friction force between the inner ring and the friction board. The friction force can be changed depending on the push of the spring 2. Thus, the torque can be adjusted. In this torque limiter, a rotating direction of the inner ring does not depends on a winding direction of the spring.

EXAMPLES 1 TO 6

Comparative Examples 1 to 15

With the following non-limiting examples, the lubricating composition for the torque limiter according to the present invention will be schematically described. Abbreviations of respective components used in EXAMPLES and COMPARATIVE EXAMPLES are listed below. A mixing percentage is expressed in % by weight.

PAO: poly-α-olefin hydride (manufactured by Mobil Corporation, SHF401 having kinetic viscosity at 40° C. of 377 $mm^2/S$)

EAO: ethylene-α-olefin copolymer (manufactured by Mitsui Chemicals, Inc., Lucant HC20 having kinetic viscosity of 155 $mm^2/S$ at 40° C.)

AN: alkylnaphthalene (having kinetic viscosity at 40° C. of 27 $mm^2/S$)

TCP: tricresyl phosphate

PE1: trioleyl phosphate

PE2: trioleyl phosphite

FR: stylene-α-methylstylene—aliphatic copolymer resin (having a specific gravity of 1.03, and a softening point of 125° C.)

DTBP: antioxidant (di-t-butylphenol)

BTA: metal deactivator (benzotriazole derivative)

TL: rust preventive agent (amine phosphate)

Each lubricating composition was prepared by mixing respective components in a ratio shown in TABLES 1 and 2. TABLE 1 shows examples of oily lubricants, and TABLE 2 shows examples of greases using a lithium soap as a thickener. In the TABLES 1 and 2, "Bal" means a balance other than the component(s) represented by number (parts by weight) based on the total 100 parts by weight. In TABLE 1, 0.5 parts by weight of DTBP, 0.03 parts by weight of BTA, and 0.03 parts by weight of TL in all experiments, and therefore such description is omitted. In TABLE 2, 1.0 parts by weight of DTBP, 0.1 parts by weight of BTA, and 0.1 parts by weight of TL in all experiments, and therefore such description is omitted.

TABLE 1

| | EXAMPLE | | | | COMPARATIVE EXAMPLE | | | | | | | | |
|---|---|---|---|---|---|---|---|---|---|---|---|---|---|
| | 1 | 2 | 3 | 4 | 1 | 2 | 3 | 4 | 5 | 6 | 7 | 8 | 9 |
| Base Oil | | | | | | | | | | | | | |
| PAO | Bal | Bal | — | — | Bal | Bal | Bal | Bal | — | — | — | — | — |
| EAO | — | — | Bal | Bal | — | — | — | — | Bal | Bal | Bal | Bal | — |
| AN | — | — | — | — | — | — | — | — | — | — | — | — | Bal |
| Phosphoric acid or phosphorous acid ester | | | | | | | | | | | | | |
| TCP | — | — | — | — | — | — | 4 | — | — | — | 4 | — | 4 |
| PE1 | — | 4 | — | 4 | — | — | — | — | — | 0.8 | — | 9 | — |
| PE2 | 4 | — | 4 | — | — | 0.8 | — | 9 | — | — | — | — | — |
| FR | — | — | — | — | — | — | — | — | — | — | — | — | 20 |

TABLE 2

| | EX-AMPLE | | COMPARATIVE EXAMPLE | | | | | |
|---|---|---|---|---|---|---|---|---|
| | 5 | 6 | 10 | 11 | 12 | 13 | 14 | 15 |
| Base Oil | | | | | | | | |
| PAO | Bal | — | Bal | Bal | — | Bal | — | — |
| EAO | — | Bal | — | — | Bal | — | Bal | — |
| AN | — | — | — | — | — | — | — | Bal |
| Phosphoric acid or phosphorous acid ester | | | | | | | | |
| TCP | — | — | — | — | — | — | 4 | 4 |
| PE1 | — | 4 | — | 0.8 | — | — | — | — |
| PE2 | 4 | — | — | — | 0.8 | 9 | — | — |
| FR | — | — | — | — | — | — | — | 20 |

Torque Stability Test

Figure 5:
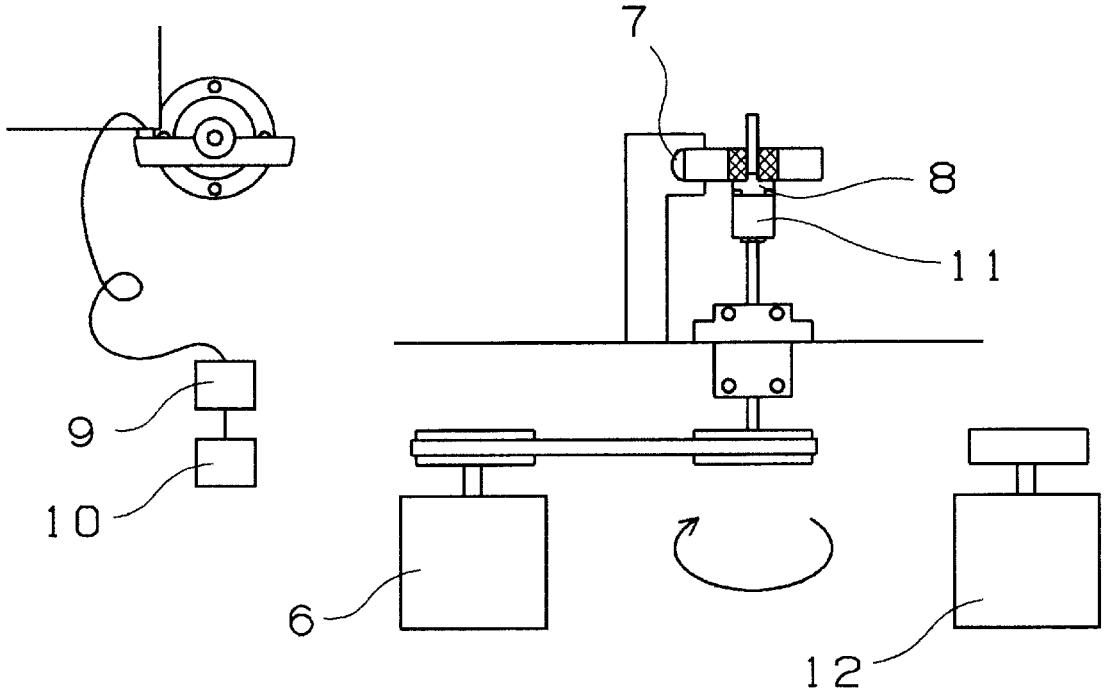
FIG. 5 is a schematic view of a torque stability tester.

A tester was assembled in-house. A torque limiter evaluated was NTS18 made by NTN corporation. FIG. 5 illustrates the torque stability tester comprising a motor 6 for rotating an axis, a load cell 7 for detecting torque, a coupling 8, a strain gauge 9, and a recorder 10. The torque limiter 11 having a sintered inner ring which was impregnated with each sample oil was set on the rotating axis, and was rotated in a torque producing direction of the limiter. The torque produced was transmitted to the load cell, and was recorded by the recorder 10. There was also a low-speed motor 12, which was interchangeably with the high-seed motor 6. In FIG. 5, a left side figure is a top plan view.

The test conditions were as follows: setting torque of 350 gf·cm, revolution numbers of 220 rpm, operation cycle of 1.5 sec operation −0.5 sec stop intermittently, atmosphere temperature: room temperature, test time: 1000 hours. Measured items are as follows: a touch after the test, a change in torque after 0, 500, and 1000 hours (change with the time elapsed, a change in torque per minute), and presence or absence of an abnormal sound during operation. The torque was measured per predetermined time with the torque-measuring tester. The test results are shown in TABLE 3. In TABLE 3, "G" represents a torque reduction of 20 gf·cm or less, and "P" represents a torque reduction of more than 20 gf·cm or more, after 1 minute torque measurement.

Chemical Attack Resistance Test

At peripheral parts of the torque limiter, polycarbonate (PC) or an ABS resin having good moldability are used. These synthetic resin molded products may be suffered from crazing or cracking, if the lubricant for use in the torque limiter is leaked, and is touched with the molded products. The lubricant according to the present invention was tested for chemical attack resistance using PC and ABS.

The test was a bending test described later. When no cracking nor crazing is produced on a test piece, it denotes "G", cracking or crazing is produced on the test piece, it denotes "P". The results are shown in TABLE 3.

TABLE 3

| | | Time elapsed (H) | | | | Abnormal | | |
|---|---|---|---|---|---|---|---|---|
| | Type | 0 | 500 | 1000 | Touch | sound | PC | ABS |
| Ex. | | | | | | | | |
| 1 | Oily | G | G | G | G | G | G | G |
| 2 | Oily | G | G | G | G | G | G | G |
| 3 | Oily | G | G | G | G | G | G | G |
| 4 | Oily | G | G | G | G | G | G | G |
| 5 | Greasy | G | G | G | G | G | G | G |
| 6 | Greasy | G | G | G | G | G | G | G |
| Comp. Ex. | | | | | | | | |
| 1 | Oily | G | P | P | G | G | G | G |
| 2 | Oily | G | P | P | G | G | G | G |
| 3 | Oily | G | G | P | G | G | P | P |
| 4 | Oily | G | G | G | G | G | P | P |
| 5 | Oily | G | P | P | G | G | G | G |
| 6 | Oily | G | P | P | G | G | G | G |
| 7 | Oily | G | G | P | G | G | P | P |
| 8 | Oily | G | G | G | G | G | P | P |
| 9 | Oily | G | G | G | G | G | P | P |
| 10 | Greasy | G | P | P | G | G | G | G |
| 11 | Greasy | G | P | P | G | G | G | G |
| 12 | Greasy | G | P | P | G | G | G | G |
| 13 | Greasy | G | G | G | G | G | P | P |
| 14 | Greasy | G | G | P | G | G | P | P |
| 15 | Greasy | G | G | G | G | G | P | P |

It is apparent from the test results that the synthetic hydrocarbon compound such as PAO and ethylene-α-olefin copolymer hydride has excellent chemical attack resistance, but only the single component has poor torque stability as an oil for the torque limiter (cf. COMPARATIVE EXAMPLES 1, 5 and 10). However, when aliphatic phosphoric acid ester or phosphorous acid ester is mixed therewith, the torque stability is improved. The torque stability can be improved provided that 1% by weight of the phosphorus based anti-wear agent is added. If the amount is less than 1% by weight as in COMPARATIVE EXAMPLES 2, 6, 11 and 12, the torque stability is less improved. If the amount exceeds 8% by weight as in COMPARATIVE EXAMPLES 4, 8, and 13, resin resistance other than the torque stability may be adversely affected. If the amount of an aromatic phosphorous based anti-wear agent, i.e., TCP, exceeds 0.5% by weight, the chemical attack resistance is poor as in COMPARATIVE EXAMPLES 3, 7 and 14. Of course, an aromatic oil such as alkyl naphthalene having excellent torque stability has also poor chemical attack resistance similar to TCP as in COMPARATIVE EXAMPLES 9 and 15.

It can conclude that when the lubricating oil for the torque limiter comprises as the base oil the synthetic hydrocarbon compound, and 1 to 8% by weight of aliphatic phosphoric acid ester and phosphorous acid ester based on 100 parts by weight of the base oil, there is provided excellent torque stability and chemical attack resistance.

As described above, the lubricating oil and lubricating grease comprising as the base oil the synthetic saturated hydrocarbon oil can provide excellent chemical attack resistance, and good torque stability in the torque limiter including the metal inner ring and the coil spring.

Then, a lubricating composition comprising at least two lubricating greases selected from the group consisting of three types of lubricating greases each having a different base oil will be described.

As the synthetic saturated hydrocarbon oil which is the base oil of the first lubricating grease, the above-described liquid polyolefin represented by the formulas (1) and (2).

As the urea compound which is added as a thickener to the polyolefin, diurea having two urea bonds in a molecule is preferable, and represented by the following formula (5).

$$R_1\text{—NHCONH—}R_3\text{—NHCONH—}R_2 \qquad \text{[Formula (5)]}$$

where $R_1$, $R_2$ and $R_3$ represents an aliphatic group, an alicylcic group or an aromatic group. An alicyclic urea and an aromatic urea in which the $R_1$ and $R_2$ are an alicyclic group and/or an aromatic group are preferable, because such compound has high temperature properties. For example, the urea compound can be obtained by reacting a diisocyanate compound with isocyanate group equivalent of an amine compound.

The silica powder is $SiO_2$ powder. In the present invention, fine silica powder is preferable. Such fine silica powder is obtained by high temperature gas phase hydrolysis of silicon tetrachloride to produce smoky $SiO_2$ and collect it.

The bentonite powder is one of hydrous silicate aluminum, and is obtained by classifying clay referred to as montmorillonite with water, surface-treating it with organic amines to provide lipophilic fine powder.

The first lubricating grease preferably comprises 70 to 90% by volume of the polyolefin, and 10 to 30% by volume of the thickener based on the total weight of the grease. Within the range, preferable consistency as the grease for prelubricating the bearing can be obtained.

The second lubricating grease comprises as the base oil perfluoropolyether oil and as the thickener fluororesin powder.

Any perfluoropolyether oils can be used as long as a hydrogen atom or hydrogen atoms of aliphatic hydrocarbon polyether are replaced with a fluorine atom or fluorine atoms. Examples include branched perfluoropolyether having a side chain represented by the following formulas (6) and (7), and linear perfluotopolyether represented by the formulas (8) to (10). These can be used alone or in combination. In the formulas (6) to (10), n and m are integers.

A commercially available example of the branched perfluoropolyether represented by the formula (6) is Fomblin Y manufactured by Montedison S.P.A. A commercially available example of the branched perfluoropolyether represented by the formula (7) is Krytox manufactured by DuPont Co., Ltd. or Barrierta J Oil manufactured by Kluber. A commercially available example of the linear perfluoropolyether represented by the formula (8) is Fomblin Z manufactured by Montedison S.P.A. A commercially available example of the linear perfluoropolyether represented by the formula (9) is Fomblin M manufactured by Montedison S.P.A. A commercially available example of the linear perfluoropolyether represented by the formula (10) is Demnum manufactured by Daikin Industries, Ltd.

[Formula (6)]

$$CF_3O\text{—}(CF_2\underset{\underset{CF_3}{|}}{C}FO)_m\text{—}(CF_2O)_n\text{—}CF_2 \qquad m/n > 40$$

[Formula (7)]

$$CF_3CF_2CF_2O\text{—}(C\underset{\underset{CF_3}{|}}{F}CF_2O)_m\text{—}CF_2CF_3$$

[Formula (8)]

$$CF_3O\text{—}(CF_2CF_2O)_m\text{—}(CF_2O)_n\text{—}CF_3 \qquad m/n < 1$$

[Formula (9)]

$$CF_3O\text{—}(CF_2CF_2O)_m\text{—}(CF_2O)_n\text{—}CF_3 \qquad m/n > 1$$

[Formula (10)]

$$F\text{—}(CF_2CF_2CF_2O)_n\text{—}CF_2CF_3$$

The fluorine resin powder which is the thickener is highly compatible with the aforementioned perfluoropolyether oils, and can provide high temperature stability, and chemical resistance.

The fluororesin is preferably a perfluoro based fluororesin such as polytetrafluoroethylene (PTFE), tetrafluoroethylene-perfluoroalkylvinylether copolymer (PFA), and tetrafluoroethyelen-hexafluoropropylene copolymer (FEP). Especially preferable is polytetrafluoroethylene (PTFE) due to its excellent high temperature stability and chemical resistance.

The second lubricating grease comprises 70 to 90% by volume of perfluoropolyether oil, and 10 to 30% by volume of the fluororesin powder based on the total weight of the grease. Within the range, preferable consistency can be obtained so that the grease for prelubricating the bearing is less leaked and torque is reduced for a long time.

The third lubricating grease comprises as the base oil alkyldiphenylether oil selected from monoalkyldiphenyl ether oil represented by the following formula (11) and/or dialkyldphenylether oil represented by the following formula (12).

[Formula (11)]

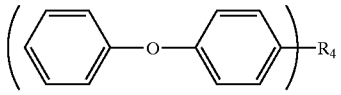

[Formula (12)]

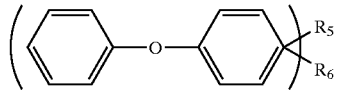

where $R_4$, $R_5$, and $R_6$ are $C_8$ to $C_{20}$ alkyl side chains, and are bonded to one phenyl ring, or two phenyl rings.

Among them, dialkyldiphenylether oil having alkyl side chains $R_5$ and $R_6$ is preferable with heat resistance and evaporation properties taking into consideration.

The third lubricating grease further comprises the thickener used in the first lubricating grease.

The third lubricating grease preferably comprises 70 to 90% by volume of the alkyldiphenylether oil, and 10 to 30% by volume of the thickener based on the total weight of the grease. Within the range, preferable consistency as the grease for prelubricating the bearing can be obtained.

Each type of grease can be prepared by any known methods. For example, the thickener is added to the base oil, stirred, and then passed through a roll mill to provide a semi-solid grease.

The grease can contain any known additives as required, as long as the polycarbonate is not damaged as determined by a bending test described later. Examples include antioxidants such as amine-based, phenol-based, or sulfur-based antioxidants, and dithiozinc phosphosphate; extreme pressure agents such as chlorine-based, sulfur-based, phosphorus-based extreme pressure agents, dithiozinc phosphosphate, and organic molybdenum; rust preventive agents such as petroleum sulfonate, dinonylnaphthalene sulfonate, and sorbitan esters; metal deactivators such as benzotriazole, and sodium nitrite; viscosity index improvers such as polymethacrylate, polyisobutylene, and polystyrene; anti-wear additives; and detergent dispersants. These can be used alone or in combination.

The lubricating composition suitable for the machine parts of the business machine including the synthetic resin molded product is prepared by adding the first lubricating grease or the third lubricating grease to the second lubricating grease, or by adding the first lubricating grease and the third lubricating grease to the second lubricating grease. Preferably, the first lubricating grease or the third lubricating grease is added to the second lubricating grease. More preferably, the first lubricating grease and the second lubricating grease are mixed. Thus prepared lubricating grease can maintain excellent heat resistance, prevent chemical attacks, and reduce costs.

The mixed lubricating grease after the first and/or third lubricating greases are added comprises 30 to 70% by volume of the second lubricating grease. If more than 70% by volume of the second grease is added, costs are ineffectively reduced. If less than 30% by volume of the second grease is added, heat resistance is significantly decreased.

The mixed lubricating grease may comprise 30 to 70% by volume of the perfluoropolyether oil, which is the base oil of the second lubricating grease, based on the whole lubricating grease instead of the second lubricating grease. This mixed lubricating grease does not decrease a dropping point, and improve the heat resistance.

The mixed lubricating grease has excellent chemical attack resistance. The chemical attack resistance is determined by a bending test. Briefly, the bending test is as follows: a polycarbonate resin plate to be coated the lubricating grease on its surface is applied a mechanical stress, and the surface is observed.

Specifically, the bending test will be described.

(1) Test Apparatus

Figure 6:
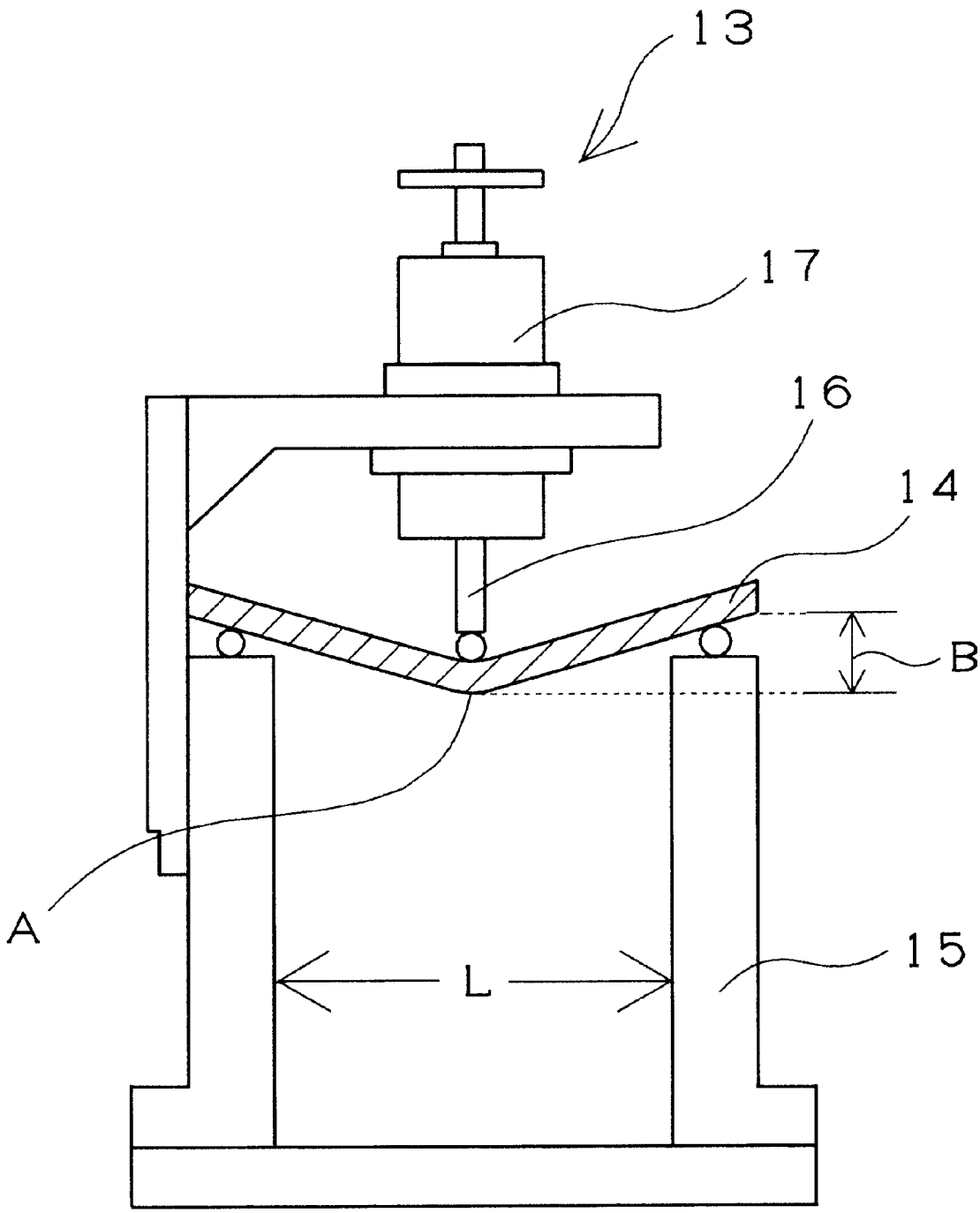
FIG. 6 is a schematic view of a bending tester.

FIG. 6 shows a schematic view of a bending test apparatus.

In a test apparatus 13, both ends of a test piece 14 are movably supported keeping a predetermined supporting distance (L), a test board 15 mounts the test piece 14 thereon, a probe 16 provides deflection (B) to the test piece 14, and a deflection adjusting device 17 supports and moves the probe 16 up and down.

(2) Test Conditions

Test piece: 127 mm (length)×12.7 mm (width)×6.5 mm (thickness)

Supporting distance: 100 mm

Deflection (at a center of the supporting distance): 3.5 mm

Temperature: 75° C.

Holding time: 3 hours

Material of the test piece: Iupilon S2000R manufactured by Mitsubishi Engineering Plastics Corp., (3) Test Method Three-point bending test is used. A surface of a bending test piece annealed at 120° C. for 2 hours is applied the lubricating grease. The test piece is supported keeping the supporting distance, is bent from an opposite surface of the applied surface, and is hold in air at 75° C. for 3 hours. Thereafter, presence or absence of cracks is visually inspected. When no cracking nor crazing is produced on the test piece, it denotes "G", cracking or crazing is produced on the test piece, it denotes "P".

Figure 7:
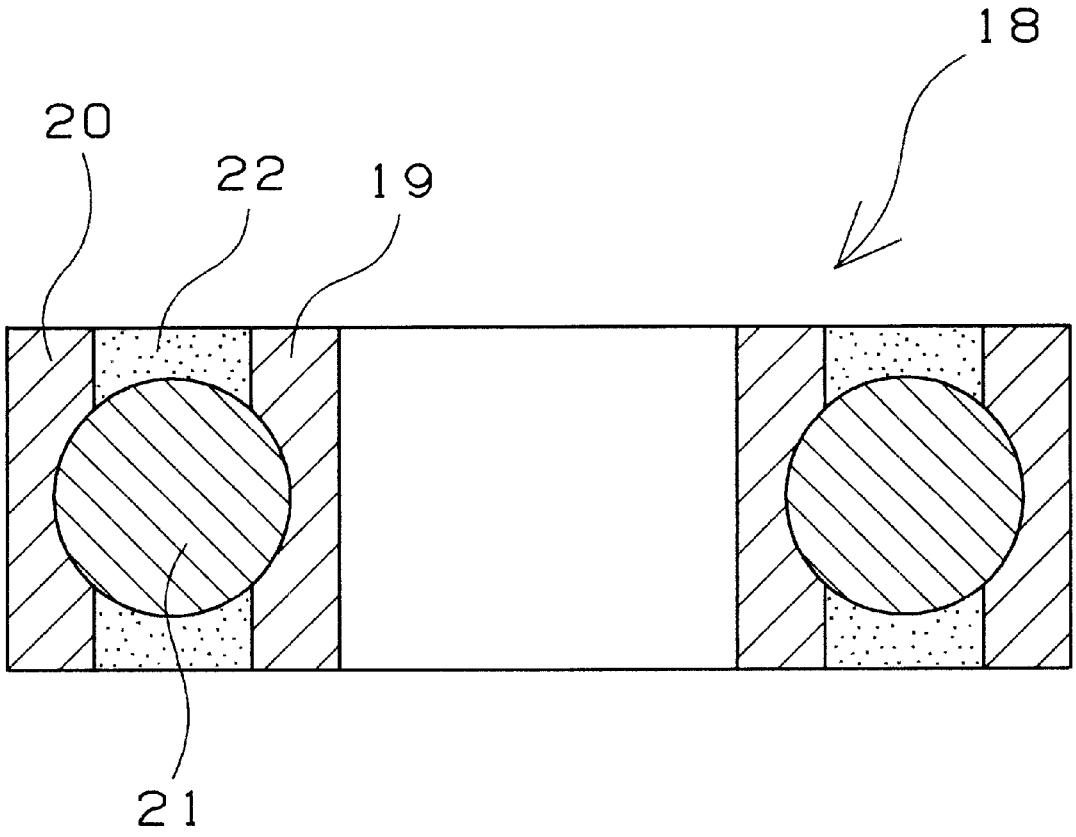
FIG. 7 is a cross-sectional view of a ball-and-roller bearing with a smaller diameter.

FIG. 7 shows a cross-sectional view of a ball-and-roller bearing with a small diameter into which the above-described lubricating composition is prelubricated. The ball-and-roller bearing supports a fixing roller of an electrophotographic apparatus.

The ball-and-roller bearing 18 comprises an inner ring 19 having a rolling surface on an outer surface, an outer ring 20 having a rolling surface on an inner surface. The inner ring 19 and the outer ring 20 are concentrically disposed. Plural rolling elements 21 are disposed between the rolling surface of the inner ring 19 and the rolling surface of the outer ring 20. The ball-and-roller bearing 18 also comprises a retainer and a sealing member (both are not shown). The aforementioned lubricating grease 22 are filled at least around the rolling elements 21.

The lubricating grease 22 is obtained by mixing different types of greases including different base oils. The lubricating grease is also used in other bearing for supporting the fixing roller of the electrophotographic apparatus.

The ball-and-roller bearing does not impair the resin parts which are susceptible to chemical attacks. Therefore, such ball-and-roller bearing is suitable for use in the fixing roller of the electrophotographic apparatus that is intended to decrease costs by utilizing many resin parts.

The fixing roller is electrostatically charged as a sheet of paper passes. The electrostatic charge is released from an earth mechanism disposed at the roller. The bearing may also have the earth mechanism. In this case, it is preferable that an adequate amount of conductive carbon be added to the lubricating grease according to the present invention, whereby conductivity is provided. Such lubricating grease having conductivity is filled into the ball-and-roller bearing for the fixing roller of the electrophotographic apparatus so that parts used in the electrophotographic apparatus are decreased. The conductive carbon is added to respective greases and then respective greases is mixed. Or, respective greases is mixed and then the conductive carbon is added thereto.

EXAMPLES 7–14

Comparative Examples 16–20

Reference Example 1

Lubricating Grease A

Based on the total grease, 80% by volume of perfluoropolyether oil (Krytox 240A manufactured by Du Pont Co., Ltd.) and 20% by volume of fluororesin powder (VYDAX manufactured by Du Pont Co., Ltd.) were mixed, stirred, and passed through a roll mill to provide a semi-solid grease A which was the second lubricating grease.

Reference Example 2

Lubricating Grease B

Based on the total grease, 85% by volume of polyolefin oil which was a copolymerized oligomer of ethylene and α-olefin (Lucant HC-20 manufactured by Mitsui Chemicals, Inc. having kinetic viscosity of 155 $mm^2/S$ at 40° C.) and 15% by volume of alicyclic urea (in the formula (5), $R_1$ and $R_2$ are cyclohexyl groups, and $R_3$ is diphenylmethane group) were mixed, stirred, and passed through a roll mill to provide a semi-solid grease B which was the first lubricating grease.

Reference Example 3

Lubricating Grease C

Based on the total grease, 90% by volume of the polyolefin oil used in the reference example 2 and 10% by volume of silica powder (R972 manufactured by Nippon Aerosil Co., Ltd.) were mixed, stirred, and passed through a roll mill to provide a semi-solid grease C which was the first lubricating grease.

Reference Example 4

Lubricating Grease D

Based on the total grease, 10% by volume of alkyldiphenylether oil (Moresco LB100 manufactured by Matsumura Oil Research Corporation having kinetic viscosity of 97 $mm^2/S$ at 40° C.) and 20% by volume of alicyclic urea (in the formula (5), $R_1$ and $R_2$ are phenyl groups, and $R_3$ is diphenylmethane group) were mixed, stirred, and passed through a roll mill to provide a semi-solid grease D which was the third lubricating grease.

Reference Example 5

Lubricating Grease E

Based on the total grease, 90% by volume of alkyldiphenylether oil used in the reference example 4 and 10% by volume of the silica powder used in the reference example 3 were mixed, stirred, and passed through a roll mill to provide a semi-solid grease E which was the third lubricating grease.

Reference Example 6

Lubricating Grease F

Based on the total grease, 85% by volume of high viscosity ester oil (KL215 manufactured by Akzo Nobel K. K. having kinetic viscosity of 120 $mm^2/S$ at 40° C.) and 15% by volume of alicyclic urea used in the reference example 2 were mixed, stirred, and passed through a roll mill to provide a semi-solid grease F.

When the cost of the lubricating grease A is to be 1.00, each cost of the lubricating greases B to F is 0.25. When the specific gravity of the lubricating grease A is to be 1.8, each specific gravity of the lubricating greases B to F is 1.0.

EXAMPLES 7 to 14

In each EXAMPLE, grease A as the essential components was mixed with the grease B, C, D, or E in the percentage shown in TABLE 4, and stirred to provide a lubricating grease. The percentage is vol % based on the whole grease.

TABLE 4 also show a dropping point, specific gravity, and a bending test result of each lubricating grease. The predetermined amount of the lubricating grease is filled into the ball-and-roller bearing with a space volume prescribed. In this case, lowering specific gravity of the lubricating grease can decrease the costs. Accordingly, each ratio of each specific gravity to the specific gravity of the grease A alone was also determined, and is also shown in TABLE 4.

A bearing 6305ZZ was filled with each of the lubricating greases having 25% of static space volume to provide a ball-and-roller bearing. The resultant ball-and-roller bearing was evaluated by a life test. The bearing was rotated under the conditions of radial load of 150 kgf, revolution numbers of 100 rpm, and an atmosphere temperature of 200° C. to measure a time until a driven motor was stopped by an overload. The results are also shown in TABLE 4.

Comparative Examples 16 and 17

In COMPARATIVE EXAMPLE 16, the grease A was mixed with the polyolefin oil used in the reference example 2 in the percentage shown in TABLE 4 to provide a lubricating grease. In COMPARATIVE EXAMPLE 17, the grease A was mixed with the alkyldiphenylether oil used in the reference example 4 in the percentage shown in TABLE 4 to provide a lubricating grease. The percentage is vol % based on the total grease. The resultant greases were evaluated as described above. The results are also shown in TABLE 4.

Comparative Examples 18 and 19

In each of COMPARATIVE EXAMPLES, the grease A was mixed with the grease D in the percentage shown in TABLE 4 to provide a lubricating grease. The resultant greases were evaluated as described above. The results are also shown in TABLE 4.

Comparative Example 20

The grease F alone was used and evaluated as described above. The results are also shown in TABLE 4.

TABLE 4

| | EXAMPLE | | | | | | | | COMPARATIVE EXAMPLE | | | | |
|---|---|---|---|---|---|---|---|---|---|---|---|---|---|
| | 7 | 8 | 9 | 10 | 11 | 12 | 13 | 14 | 16 | 17 | 18 | 19 | 20 |
| Composition | | | | | | | | | | | | | |
| Grease A | 70 | 30 | 70 | 30 | 70 | 30 | 70 | 30 | 70 | 70 | 90 | 10 | — |
| Grease B | 30 | 70 | — | — | — | — | — | — | — | — | — | — | — |

TABLE 4-continued

| | EXAMPLE | | | | | | | | COMPARATIVE EXAMPLE | | | | |
|---|---|---|---|---|---|---|---|---|---|---|---|---|---|
| | 7 | 8 | 9 | 10 | 11 | 12 | 13 | 14 | 16 | 17 | 18 | 19 | 20 |
| Grease C | — | — | 30 | 70 | — | — | — | — | — | — | — | — | — |
| Grease D | — | — | — | — | 30 | 70 | — | — | — | — | 10 | 90 | — |
| Grease E | — | — | — | — | — | — | 30 | 70 | — | — | — | — | — |
| Grease F | — | — | — | — | — | — | — | — | — | — | — | — | 100 |
| Base oil*1 | — | — | — | — | — | — | — | — | — | 30 | — | — | — |
| Base oil*2 | — | — | — | — | — | — | — | — | 30 | — | — | — | — |
| Properties | | | | | | | | | | | | | |
| Dropping point ° C.*3 | >260 | >260 | >260 | >260 | >260 | >260 | >260 | >260 | 220 | 210 | >260 | >260 | >260 |
| Bending test | G | G | G | G | G | G | G | G | G | G | G | G | P |
| Life test time*4 | >1000 | >1000 | >1000 | >1000 | >1000 | >1000 | >1000 | >1000 | — | — | >1000 | 340 | >1000 |
| Specific gravity | 1.55 | 1.24 | 1.55 | 1.24 | 1.55 | 1.24 | 1.55 | 1.24 | — | — | 1.72 | 1.08 | 1.00 |
| Specific gravity/Specific gravity of A | 0.86 | 0.69 | 0.86 | 0.69 | 0.86 | 0.69 | 0.86 | 0.69 | — | — | 0.96 | 0.60 | — |

Note)
*1polyolefin oil
*2alkyldiphenyl ether oil
*3>260 means 260° C. or more.
*4>1000 means 1000 hours or more.

As shown in TABLE 4, the lubricating greases in EXAMPLES 7 to 14 show no decrease in the dropping points and reduced costs in view of the specific gravities, and have prolonged life and excellent chemical attack resistance. In contrast, the lubricating greases in COMPARATIVE EXAMPLES 16 and 17 show decreased dropping points, and therefore the life test of the ball-and-roller bearing was ceased. The lubricating grease containing more than 70% by volume of the grease A in COMPARATIVE EXAMPLE 18 can decrease the costs inefficiently. The lubricating grease containing less than 30% by volume of the grease A in COMPARATIVE EXAMPLE 19 shortens the life. The lubricating grease containing alkyldiphenylether oil in COMPARATIVE EXAMPLE 20 as the base oil shows poor chemical attack resistance.

The ball-and-roller bearing has rolling elements which are filled with the lubricating grease according to the present invention comprising different base oils, i.e., comprising as essential components the perfluoropolyether base oil and the fluorine resin powder thickener. When the resin parts susceptible to chemical attacks are used in combination with such ball-and-roller bearing, the resin parts are not broken, which can reduce the costs of the electrophotographic apparatus. In addition, the lubricating grease of the present invention has excellent heat resistance, and is suitable for use in the bearing for supporting the fixing roller of the electrophotographic apparatus. Furthermore, the lubricating grease of the present invention can be produced in a simple step of mixing different types of lubricating greases each having intended properties, can maintain an excellent dropping point, and has excellent chemical attack resistance.

Then, a rust preventive oil according to the present invention will be described below.

As the base oil of the rust preventive oil, the above-described liquid polyolefin represented by the formula (1) or (2) can be used.

It is preferable that the polyolefin oil used as the base oil have kinetic viscosity of 10 to 400 $mm^2/s$, preferably 10 to 200 $mm^2/S$, more preferably 30 to 120 $mm^2/s$ at 100° C. If the polyolefin oil has kinetic viscosity of less than 10 $mm^2/s$, the rust preventive oil may easily cause chemical attacks. If the polyolefin oil has kinetic viscosity of more than 400 $mm^2/s$, the rust preventive oil is attached excessively.

Suitable polyolefin oil is an oligomer of α-olefin, and includes polymer of (α-olefin having about 3 to 20 carbon atoms such as butene-1, isobutylene-1, α-octene, and decene-1, or copolymer with the olefins.

In the present invention, the polyolefin oil containing 1-decene having the formula (1) or (2) where n is 8, as a main component of a monomer unit is suitable.

In particular, the polyolefin oil having the formula (1) is suitable. Preferably, the polyolefin oil contains 1-decene, which is at least trimer or more, as a main component. If the 1-decen is less than trimer, the resultant rust preventive oil may cause chemical attacks to polycarbonates under high stress.

The base oil contains polyolefin oil. The polyolefin oil may be used singly, or together with (1) normal paraffin having 20 to 48 carbon atoms and/or (2) paraffin based mineral oil containing 60% by weight of paraffin component and having an initial boiling point of 200° C. or more. When normal paraffin and the like is added to the polyolefin oil, it is preferable that at least 60% by weight or more of the polyolefin oil is contained in the base oil in view of compatibility with other additives.

The normal paraffin having 20 to 48 carbon atoms is a linear aliphatic hydrocarbon having a melting point of about 50 to 70° C., and is referred to as paraffin wax. In particular, highly purified paraffin wax containing no component having a low melting point, which may induce chemical attacks, is preferable.

The paraffin based mineral oil containing 60% by weight or more of the paraffin component and an initial boiling point of 200° C. or more is preferable since it is rich in paraffin and can prevent chemical attacks. To provide preferable lubricating properties, the base oil includes 0.5% by weight or less of a sulfur content, has total acid number of 0.05 mgKOH/g or less, and includes less than 3% by weight of a polynuclear aromatic compound (PCA).

Examples of a rust preventive agent that can be added to the base oil include a metal salt of sulfonic acid, a metal salt of monocarboxylic acid, or a mixture thereof.

The metal salt of sulfonic acid is a metal salt of aromatic hydrocarbon sulfonic acid. Specifically, it is a metal salt of synthesized sulfonic acid such as petroleum sulfonic acid obtained by sulfonation of aromatic hydrocarbons in a lubricant fraction, dinonylnaphthalene sulfonic acid, or alkyibenzene sulfonic acid. Examples of metal in the metal salt include sodium, magnesium, calcium, zinc, and barium.

The metal salt of monocarboxylic acid is a metal salt of saturated or unsaturated monocarboxylic acid represented by $C_nH_{2n-3}COOH$, $C_nH_{2n-1}COOH$, or $C_nH_{2n+1}COOH$, where n is an integer of 10 to 20. If a metal salt of lower monocarboxylic acid in which n is less than 10, chemical attacks are easily induced. If a metal salt of higher monocarboxylic acid in which n exceeds 20, it becomes difficult to handle, i.e., it becomes difficult to dissolve. Examples of the metal in the metal salt include sodium, magnesium, aluminum, calcium, copper, zinc and the like. In the present invention, if the rust preventative contained the metal salt of $C_nH_{2n-3}COOH$ as the main component, excellent results were obtained through experiments.

Furthermore, as a result of the experiments described later, it was found that a suitable rust preventative was a mixture of the metal salt of sulfonic acid and the metal salt of monocarboxylic acid.

The phenol based antioxidant is a phenol or a phenol derivative such as cresol. Examples include 4,4-butylidene-bis(6-t-butyl-m-cresol), 2,2-methylene-bis(4-methyl-6-t-butylphenol), 2,2-methylene-bis(4-ethyl-6-t-butylphenol), 4,4-thio-bis(6-t-butyl-m-cresol), 2,6-di-t-butyl-p-cresole, 2,5-di-t-butylamylhydroquinone, 2,5-di-t-butylhydroquinone, and the like. These do not induce chemical attacks to the resin molded products.

The rust preventive oil contains 1 to 95% by weight, preferably 50 to 90% by weight of the base oil containing the polyolefin oil, 1 to 80% by weight, preferably 10 to 50% by weight of the rust preventative, and 0.01 to 5% by weight, preferably 0.1 to 1.0% by weight of the antioxidant. Such rust preventive oil can prevent chemical attacks.

The rust preventive oil can be adjusted to have adequate viscosity for easy rust preventive processing of the machine parts in the business machine. It is preferable that the rust preventive oil have kinetic viscosity of 15 to 250 $mm^2/s$ at 40° C. If the rust preventive oil has kinetic viscosity of less than 15 $mm^2/s$, it easily causes chemical attacks. If the rust preventive oil has kinetic viscosity of more than 250 $mm^2/s$, it is attached excessively.

The rust preventive oil of the present invention has excellent chemical attack resistance. The chemical attack resistance is determined by the bending test described above in which a polycarbonate resin plate having the rust preventive oil on its surface is applied a mechanical stress, and the surface is observed. When no cracking nor crazing is produced on a test piece, it denotes "G", cracking or crazing is produced on the test piece, it denotes "P". In the bending test of the rust preventive oil, a test piece having a length of 152 mm, a width of 12.5 mm, and a thickness of 6.35 mm was used.

The peripheral of the rolling element 21 in the ball-and-roller bearing shown in FIG. 7 can be rust prevented with the rust preventive oil described above.

The rust preventive oil can be applied to the ball-and-roller bearing 18 using various applying methods including a spray method and a dipping method. The applying methods are not especially limited. It is preferable that a thickness of the rust preventive oil applied be 1 $\mu$m or less with handling of the bearing and effect to the grease filled taking into consideration.

The chemical attacks caused not only by the rust preventive oil but also by the grease filled to the resin molded products should be prevented. Preferably, the grease contains the polyolefin as the base oil. The grease further comprises the thickener which is at least one selected from the group consisting of a lithium soap, a sodium soap, an urea compound, silica powder and bentonite powder.

The ball-and-roller bearing that is rust prevented with the above-described rust preventive oil and is filled with the grease containing the above-described polyolefin as the base oil does not harm the resin parts which are easily damaged by chemical attacks. Accordingly, such ball-and-roller bearing is suitable for use in a rotating portion of the business machine that is intended to decrease costs by utilizing many resin parts.

In the torque limiters shown in FIGS. 1 to 4, the metal parts such as the metal inner ring 1 and the coil spring 2 are rust prevented with the rust preventive oil.

EXAMPLES 15–18

Comparative Examples 21–24

Reference Examples 7 to 10 Combinations of the Base Oils

A combination of the base oils is studied. The materials were used and mixed in a ratio shown in TABLE 5 to prepare the rust preventive oils. The chemical attack resistance of each rust preventive oils were evaluated by the above-described bending test. The results are also shown in TABLE 5.

The materials used are as follows:

(1) Polyolefin oil: polyolefin oil including 1-decene, which is mainly tetramer to hexamer (2) Light mineral oils having an initial boiling point of 150° C., and including 18% by weight of aromatics and 50% by weight of paraffin (3) Naphthene based mineral oils having an initial boiling point of 250° C., and including 8% by weight of aromatics and 32% by weight of paraffin (4) Normal paraffin: paraffin wax comprising normal paraffin having 20 to 48 carbon atoms (5) Paraffin based mineral oils having an initial boiling point of 250° C. or more, and including 60% by weight or more of paraffin and 0.2% by weight or less of sulfur content, having total acid number of 0.05 mgKOH/g or less, and including less than 3% by weight of a polynuclear aromatic compound (PCA)

TABLE 5

| | Reference example | | | |
|---|---|---|---|---|
| | 7 | 8 | 9 | 10 |
| Composition | | | | |
| Poly-α-olefin | 90 | 90 | 90 | 90 |
| Light mineral oil | 10 | — | — | — |
| Naphthene based mineral oil | — | 10 | — | — |
| Paraffin based mineral oil | — | — | 10 | — |
| Paraffin wax | — | — | — | 10 |
| Chemical attack resistance (deflection) | | | | |
| 3.0 mm | PPPPP | PPPPP | GGGPP | GGGGG |
| 2.5 mm | PPPPP | PPPPP | GGGGG | GGGGG |
| 2.0 mm | PPPPP | GGGGG | GGGGG | GGGGG |

As shown in TABLE 5, a combination of the polyolefin oil and the paraffin wax, and a combination of the polyolefin oil and the paraffin based mineral oil show no chemical attack.

Reference Examples 11 to 18

Various rust preventive agents containing the polyolefin oil as the main component are studied. The polyolefin oil, the paraffin wax, and the paraffin based mineral oil were the same materials used in the reference examples 7 to 10. These materials were used and mixed in a ratio shown in TABLE 6 to prepare the rust preventive oils. The chemical attack resistance of each rust preventive oils were evaluated by the above-described bending test. The results are also shown in TABLE 6.

The materials used are as follows:

(6) Rust preventive agent 1: synthesized barium sulfonate
(7) Rust preventive agent 2: fatty acid zinc
(8) Rust preventive agent 3: oxidized wax derivative (a mixture of a barium salt of paraffin hydrocarbon oxide polymer, alcohol, and ester)
(9) Rust preventive agent 4: lanolin fatty acid ester (polyhydric alcohol ester of lanolin (wool fat) fatty acid)
(10) Rust preventive agent 5: alkenyl succinic acid ester
(11) Rust preventive agent 6: sulfonic acid amine salt
(12) Rust preventive agent 7: oxidized hydrocarbon amine salt
(13) Rust preventive agent 8: alkyl phosphoric acid ester monoalkylamine salt

TABLE 6

| | Reference example | | | |
|---|---|---|---|---|
| | 11 | 12 | 13 | 14 |
| Composition | | | | |
| Poly-α-olefin | 60 | 60 | 60 | 60 |
| Paraffin wax | 10 | 10 | 10 | 10 |
| Barium sulfonate | 20 | — | — | — |
| Monocaroboxylic acid zinc | — | 20 | — | — |
| Oxide wax derivative | — | — | 20 | — |
| Lanoline fatty acid ester | — | — | — | 20 |
| Paraffin based mineral oil | 10 | 10 | 10 | 10 |
| Chemical attack resistance (deflection) | | | | |
| 3.0 mm | PPPPP | PPPPP | PPPPP | PPPPP |
| 2.5 mm | GGGGG | GGGGG | PPPPP | PPPPP |
| 2.0 mm | GGGGG | GGGGG | GGGPP | GPPPP |

| | Reference example | | | |
|---|---|---|---|---|
| | 15 | 16 | 17 | 18 |
| Composition | | | | |
| Poly-α-olefin | 60 | 60 | 60 | 60 |
| Paraffin wax | 10 | 10 | 10 | 10 |
| Alkenyl succinic acid ester | 20 | — | — | — |
| Sulfonic acid amine salt | — | 20 | — | — |
| Oxidized hydrocarbon amine salt | — | — | 20 | — |
| Alkyl phosphoric acid ester monoalkyl amine salt | — | — | — | 20 |
| Paraffin based mineral oil | 10 | 10 | 10 | 10 |
| Chemical attack resistance (deflection) | | | | |
| 3.0 mm | PPPPP | PPPPP | PPPPP | PPPPP |
| 2.5 mm | PPPPP | PPPPP | PPPPP | PPPPP |
| 2.0 mm | GPPPP | GGPPP | GGPPP | GGPPP |

As shown in TABLE 6, the rust preventive oil containing the synthesized barium sulfonate or fatty acid zinc shows no chemical attack.

Reference Examples 19 to 22

Various antioxidants containing the polyolefin oil as the main component are studied. The polyolefin oil, the paraffin wax, and the paraffin based mineral oil were the same materials used in the reference examples 7 to 10. These materials were used and mixed in a ratio shown in TABLE 7 to prepare the rust preventive oils. The chemical attack resistance of each rust preventive oils were evaluated by the above-described bending test. The results are also shown in TABLE 7. The materials used are as follows:

(14) Antioxidant 1: phenol based antioxidant 1 (2,6-di-t-butyl-p-cresol)
(15) Antioxidant 2: phenol based antioxidant 2 (2,2-methylene-bis(4-ethyl-6-t-butylphenol))
(16) Antioxidant 3: amine based antioxidant 1 (bis(4-dimethylaminophenyl)methane
(17) Antioxidant 4: amine based antioxidant 2 (N,N-diphenyl-p-phenylene diamine)

TABLE 7

| | Reference example | | | |
|---|---|---|---|---|
| | 19 | 20 | 21 | 22 |
| Composition | | | | |
| Poly-α-olefin | 89.5 | 89.5 | 89.5 | 89.5 |
| Paraffin wax | 10 | 10 | 10 | 10 |
| Phenol based antioxidant 1 | 0.5 | — | — | — |
| Phenol based antioxidant 2 | — | 0.5 | — | — |
| Amine based antioxidant 1 | — | — | 0.5 | — |
| Amine based antioxidant 2 | — | — | — | 0.5 |
| Chemical attack resistance (deflection) | | | | |
| 3.0 mm | GGGGG | GGGGG | PPPPP | PPPPP |
| 2.5 mm | GGGGG | GGGGG | GGPPP | GGPPP |
| 2.0 mm | GGGGG | GGGGG | GGGGG | GGGGG |

As shown in TABLE 7, the antioxidant containing the phenol antioxidant shows no chemical attack.

EXAMPLES 15 TO 18

Based on the chemical attack resistance results in the reference examples 7 to 22, the rust preventive oils in a ratio shown in TABLE 8 were prepared to evaluate the chemical attack resistance therefor by the above-mentioned bending test. The results of the chemical attack resistance are shown in TABLE 8. Also, the following rust prevention tests were performed. The results of the rust prevention tests are shown in TABLE 9 to 12.

Rust Prevention Test-1

In accordance with a salt spray test defined in JIS K 2246 "rust preventive oil", a rust prevention test was performed. Also, this rust prevention test-1 was performed on the rust preventive oils in reference examples 11 and 12 that show no chemical attack. Evaluation was made by checking rust after 8, 24, 32, and 48 hours to define grades in accordance with JIS K 2246 "rust preventive oil". The results are shown in TABLE 9.

Rust Prevention Test-2

(1) Test piece: 695 open rust preventive product (bearing)
(2) Rust preventive method: The test piece was dipped into an oily agent containing a cleaning solvent (paraffin based) and 2% by weight of a test oily agent dispersed therein to provide rust prevention.

(3) Test conditions: a cycle of standing at a temperature of 60° C., relative humidity of 95% for 20 hours, and standing at a temperature of 20° C., relative humidity of 30% for 4 hours
(4) Test time: until rust was observed (at most 4 hours)
(5) Number of test pieces: 10
(6) Evaluation: Accumulated numbers of rust was checked after 7, 14, 21, and 28 days. The results are shown in TABLE 10.

Rust Prevention Test-3
(1) Test piece: W688AZZ (bearing)
(2) Test procedures:
A. The test piece bearing was dipped in a test oily agent to subject rust prevention.
B. The bearing was put into a plastic bag having a thickness of 50 μm and sealed.
C. The plastic bag was stood at a temperature of 60° C., relative humidity of 90% for 14 days.
D. The plastic bag was stood at a temperature of 15° C., relative humidity of 15% for one night.
E. The bearing was detected for rust at room temperature and room humidity.
(3) Number of test pieces: 20
(4) Evaluation: Numbers of rust was checked after the test procedure was finished. The results are shown in TABLE 10.

Rust Prevention Test-4
(1) Test piece: SPCC test piece (80×60×2 mm)
(2) Test procedure:
A. The test piece was dipped in a test oily agent, taken out therefrom, and suspended in a wet test bath.
B. The bearing was applied a cycle of standing at a temperature of 50° C., relative humidity of 95% for 20 hours, and standing at room temperature for 4 hours.
(3) Test time: until rust was observed (at most 1000 hours)
(4) Number of test pieces: 5
(5) Evaluation: A time until rust was observed was recorded. The results are shown in TABLE 11.

Rust Prevention Test-5
An oil stain test was performed in accordance with MIL C 22235A. The results are shown in TABLE 12.

Comparative Example 21

A rust preventive oil was prepared by mixing 77% by weight of the naphthene based mineral oil used in the reference example 8, 10% by weight of green petrolatum, 7.0% by weight of the oxidized wax derivative used in the reference example 13, 5.0% by weight of the lanoline fatty acid ester used in the reference example 14, and 1.0% by weight of bis(4-dimethylaminophenyl)methane. Thus obtained rust preventive oil was tested for the chemical attack resistance and rust preventive property under the same conditions in EXAMPLE 15. The results are shown in TABLES 8 to 12.

Comparative Example 22

A rust preventive oil was prepared by mixing 53.8% by weight of the naphthene based mineral oil used in the reference example 8, 21.4% by weight of the paraffin based mineral oil used in the reference example 9, 14.5% by weight of green petrolatum, 4.9% by weight of the oxidized wax derivative used in the reference example 13, 3.5% by weight of the lanoline fatty acid ester used in the reference example 14, 1.0% by weight of the synthesized barium sulfonate used in the reference example 11, and 1.0% by weight of bis(4-dimethylaminophenyl)methane. Thus obtained rust preventive oil was tested for the chemical attack resistance and rust preventive property under the same conditions in EXAMPLE 15. The results are shown in TABLES 8, and 10 to 12.

Comparative Example 23

The rust preventive oil corresponding to JIS K2246 (rust preventive oil) NP-3 was tested for the chemical attack resistance and rust preventive property under the same conditions in EXAMPLE 15. The results are shown in TABLES 8, and 10 to 12.

Comparative Example 24

A rust preventive oil was prepared by mixing 86.5% by weight of the polyolefin oil used in the reference example 7, 5.0% by weight the oxidized wax derivative used in the reference example 13, 4.5% by weight of the synthesized barium sulfonate used in the reference example 11, 3.0% by weight of the alkenyl succinic acid ester used in the reference example 15 and 1.0% by weight of 2,6-di-t-buthyl-p-cresol. Thus obtained rust preventive oil was tested for the chemical attack resistance and rust preventive property under the same conditions in EXAMPLE 15. The results are shown in TABLES 8, and 10 to 12.

TABLE 8

| | EXAMPLE | | | |
|---|---|---|---|---|
| | 15 | 16 | 17 | 18 |
| Composition | | | | |
| Poly-α-olefin | 59.5 | 69.5 | 45 | 55 |
| Paraffin wax | 10 | 10 | 10 | — |
| Barium sulfonate | 10 | 5 | 15 | 15 |
| Monocaroboxylic acid zinc | 10 | 10 | 14.5 | 14.5 |
| Paraffin based mineral oil | 10 | 5 | 15 | 15 |
| Phenol based antioxidant | 0.5 | 0.5 | 0.5 | 0.5 |
| Chemical attack resistance (deflection) | | | | |
| 3.0 mm | GGPPP | GGGGG | GGPPP | GGPPP |
| 2.5 mm | GGGGG | GGGGG | GGGGG | GGGGG |
| 2.0 mm | GGGGG | GGGGG | GGGGG | GGGGG |

| | COMPARATIVE EXAMPLE | | | |
|---|---|---|---|---|
| | 21 | 22 | 23 | 24 |
| Chemical attack resistance (deflection) | | | | |
| 3.0 mm | PPPPP | PPPPP | PPPPP | PPPPP |
| 2.5 mm | PPPPP | PPPPP | PPPPP | PPPPP |
| 2.0 mm | GGGPP | GGGGG | GGGGP | PPPPP |

TABLE 9

| | Rust production grade after respective test hours | | | |
|---|---|---|---|---|
| | 8 hours | 24 hours | 32 hours | 48 hours |
| Ex. 15 | grade A | grade A | grade A | grade A |
| Ex. 16 | grade A | grade A | grade A | grade B |
| Ex. 17 | grade A | grade A | grade A | grade A |
| Ex. 18 | grade A | grade A | grade A | grade C |
| ref. ex. 11 | grade A | grade A | grade B | grade E |

TABLE 9-continued

| | Rust production grade after respective test hours | | | |
|---|---|---|---|---|
| | 8 hours | 24 hours | 32 hours | 48 hours |
| ref. ex. 12 | grade A | grade A | grade B | grade E |
| Comp. Ex. 21 | grade A | grade A | grade A | grade A |

TABLE 10

| | Rust prevention test-2 Rust production number | | | | Rust prevention test-3 Rust production |
|---|---|---|---|---|---|
| | 7 days | 14 days | 21 days | 28 days | number |
| Ex. 15 | 0 | 0 | 0 | 1 | 5 |
| Ex. 16 | 0 | 0 | 0 | 1 | 5 |
| Ex. 17 | 0 | 0 | 1 | 2 | 13 |
| Ex. 18 | 0 | 1 | 1 | 1 | 7 |
| Comp. Ex. 22 | — | — | — | — | 17 |
| Comp. Ex. 23 | 0 | 0 | 0 | 1 | — |
| Comp. Ex. 24 | 3 | 8 | 8 | 9 | 9 |

TABLE 11

| | Rust prevention test-4, rust production time (hr) | | | | |
|---|---|---|---|---|---|
| | No. 1 | No. 2 | No. 3 | No. 4 | No. 5 |
| Ex. 15 | 1,000 or more | 1,000 or more | 1,000 or more | 1,000 or more | 1,000 or more |
| Ex. 16 | 1,000 or more | 1,000 or more | 1,000 or more | 1,000 or more | 1,000 or more |
| EX. 17 | 1,000 or more | 1,000 or more | 1,000 or more | 1,000 or more | 1,000 or more |
| Ex. 18 | 1,000 or more | 1,000 or more | 1,000 or more | 1,000 or more | 1,000 or more |
| Comp. Ex. 22 | — | — | — | — | — |
| Comp. Ex. 23 | 1,000 or more | 1,00-0 or more | 1,000 or more | 1,000 or more | 1,000 or more |
| Comp. Ex. 24 | 24 | 48 | 48 | 72 | 144 |

TABLE 12

| | Rust prevention test-4, appearance of test piece | |
|---|---|---|
| | Test oily agent | Test oily agent + 5% of water |
| Ex. 15 | No stain | No stain |
| Ex. 16 | No stain | No stain |
| Ex. 17 | No stain | No stain |
| Ex. 18 | No stain | No stain |
| Comp. Ex. 21 | No stain | No stain |
| Comp. Ex. 22 | No stain | No stain |
| Comp. Ex. 23 | — | — |
| Comp. Ex. 24 | — | — |

As shown in TABLE 8, the rust preventive oil in each EXAMPLE show excellent chemical attack resistance and rust preventive property. The rust preventive oils in the reference examples 11 and 12 have excellent chemical attack resistance, but poor rust preventive property as compared with those in EXAMPLES. It is therefore conclude that a mixture of the metal salt of sulfonic acid and the metal salt of monocarboxylic acid is effective for rust prevention.

In the bending test for evaluating the chemical attack resistance, the test piece has practically sufficient performance, if it is not broken at 2.5 mm change. As shown in TABLE 8, the test pieces in EXAMPLES show sufficient performance. In contrast, all test pieces in EXAMPLES 21 to 23 were broken, and cannot be used as the ball-and-roller bearing and the torque limiter for the machine parts in the business machine in which many resin parts are used.

The rust preventive oil according to the present invention has excellent chemical attack resistance and rust preventive property to the resin molded products used in the peripheral of the machine parts in the business machine.

In particular, excellent rust preventive property is obtained by using a combination of the metal salt of sulfonic acid and the metal salt of monocarboxylic acid in the rust preventive oil.

What is claimed is:

1. A lubricating composition for use in a torque limiter, said lubricating composition having resistance to the chemical attack of a synthetic resin molded product, said composition consisting essentially of a base oil, and a compounding agent, wherein the base oil is a synthetic saturated hydrocarbon oil, wherein the compounding agent is at least one phosphoric acid ester selected from the group consisting of an aliphatic phosphoric acid ester and an aliphatic phosphorous acid ester, and wherein 1 to 8% by weight of the phosphoric acid ester is contained in the lubricating composition based on 100 parts by weight of the base oil.

2. A lubricating composition as claimed in claim 1, which is a lubricant or a lubricating grease for use in a machine part of a business machine including the synthetic resin molded product.

3. A lubricating composition as claimed in claim 1, wherein said base oil is at least one synthetic saturated hydrocarbon oil selected from the group consisting of a poly-α-olefin, and an ethylene-α-olefin copolymer.

4. A lubricating composition as claimed in claim 1, wherein the torque limiter has a mechanism that torque is produced by tightening and binding force of a spring, or a mechanism that torque is produced by forcing a friction board with the spring.

5. A lubricating composition as claimed in claim 1, which is a lubricant, or a lubricating grease for use in an impregnated bearing of a torque limiter.

6. A lubricating composition having chemical attack resistance for a synthetic resin molded product, comprising a lubricating grease comprising a perfluoro polyether oil as the base oil, and fluororesin powder as a thickener and at least one lubricating grease selected from the group consisting of two types of lubricating greases each having a different base oil; the first lubricating grease comprising as the base oil at least one synthetic saturated hydrocarbon oil selected from the group consisting of a poly-α-olefin, and an ethylene-α-olefin copolymer, and at least one thickener selected from the group consisting of an urea compound silica powder and bentonite powder; and the second lubricating grease comprising an alkyldiphenylether oil as the base oil, and at least one thickener selected from the group consisting of an urea compound, silica powder, and bentonite powder.

7. A lubricating composition as claimed in claim 6, wherein the lubricating composition comprises 30 to 70% by volume of the second lubricating grease.

8. A lubricating composition as claimed in claim 6, which is a lubricating grease filled in a ball-and-roller bearing having an inner ring and an outer ring disposed concentrically, and a plurality of rolling elements disposed between the inner and outer rings.

9. A lubricating composition as claimed in claim 8, wherein the ball-and-roller bearing is used in a machine part of a business machine including the synthetic resin molded product.

10. A lubricating composition as claimed in claim 8, wherein the ball-and-roller bearing is used in a bearing of an electrophotographic apparatus.

11. A lubricating composition as claimed in claim 10, wherein the bearing of the electrophotographic apparatus supports a fixing roller.

12. A rust preventive oil having chemical attack resistance for a synthetic resin molded product, consisting essentially of a base oil, a rust preventive agent, and an antioxidant, wherein the base oil is at least one synthetic saturated hydrocarbon oil selected from the group consisting of a poly-α-olefin, and an ethylene-α-olefin copolymer, wherein the rust preventive agent is at least one metal salt selected from the group consisting of a metal salt of sulfonic acid, and a metal salt of a monocarboxylic acid, and wherein the antioxidant is a phenol based antioxidant.

13. A rust preventive oil as claimed in claim 12, wherein the base oil comprises a polyolefin oil, and at least one selected from the group consisting of a normal paraffin having 20 to 48 carbon atoms, and a paraffin based mineral oil containing 60% by weight or more of a paraffin component, and having an initial boiling point of 200° C. or more.

14. A rust preventive oil as claimed in claim 12, which comprises 1 to 95% by weight of the base oil, 1 to 80% by weight of the rust preventive agent, and 0.01 to 5% by weight of the antioxidant based on the whole rust preventive oil.

15. A rust preventive oil as claimed in claim 14, which is used in a machine part of a business machine including the synthetic resin molded product.

16. A rust preventive oil as claimed in claim 14, wherein the machine part of the business machine is a ball-and-roller bearing.

17. A rust preventive oil as claimed in claim 14, wherein the machine part of the business machine is a torque limiter.

* * * * *